US009905170B2

(12) United States Patent
Carpenter et al.

(10) Patent No.: US 9,905,170 B2
(45) Date of Patent: Feb. 27, 2018

(54) CONTROL OF LED ARRAY IN A LIQUID CRYSTAL DISPLAY ASSEMBLY

(71) Applicant: GM GLOBAL TECHNOLOGY OPERATIONS LLC, Detroit, MI (US)

(72) Inventors: James A. Carpenter, Rochester Hills, MI (US); Thomas A. Seder, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/186,590

(22) Filed: Jun. 20, 2016

(65) Prior Publication Data

US 2017/0365222 A1 Dec. 21, 2017

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2320/0252* (2013.01); *G09G 2320/041* (2013.01); *G09G 2320/0646* (2013.01); *G09G 2330/021* (2013.01)

(58) Field of Classification Search
CPC .. G09G 3/342; G09G 3/36; G09G 2320/0252; G09G 2320/041; G09G 2320/0633; G09G 2320/064; G09G 2320/0646; G09G 2330/021; H05B 33/0824; H05B 33/0815; H05B 33/0818; H05B 33/0833; H05B 33/0845; H05B 33/0851
See application file for complete search history.

(56) References Cited

U.S. PATENT DOCUMENTS 6,329,758 B1 * 12/2001 Salam ..... G09G 3/3216 315/169.2
6,870,325 B2 * 3/2005 Bushell ..... H05B 33/0854 315/224
8,087,787 B2 * 1/2012 Medin ..... G03B 21/16 353/52

(Continued)

*Primary Examiner* — Tom Sheng
(74) *Attorney, Agent, or Firm* — Quinn IP Law

(57) ABSTRACT

A display assembly includes a display unit having a liquid crystal layer and an LED array configured to illuminate the liquid crystal layer. A driver circuit is operatively connected to the LED array and configured to control a luminance of the LED array. A control module is operatively connected to the display unit and includes a processor and tangible, non-transitory memory on which is recorded instructions for executing a method for controlling the LED array in the display unit. The control module is programmed to obtain a junction temperature ($T_J$) of the LED array, via the driver circuit. The junction temperature ($T_J$) is based at least partially on a first voltage ($V_1$), a second voltage ($V_2$) and a predetermined coefficient ($T_{coefficient}$). The control module may be programmed to enter one of a plurality of stages based at least partially on the junction temperature ($T_J$).

20 Claims, 3 Drawing Sheets

(56) References Cited

U.S. PATENT DOCUMENTS

| | | | | |
|---|---|---|---|---|
| 8,093,825 | B1 * | 1/2012 | Van Ess | H05B 33/0818 315/291 |
| 8,446,108 | B2 * | 5/2013 | Zhang | H05B 33/0854 315/117 |
| 9,572,209 | B2 * | 2/2017 | Hu | H05B 33/0815 |
| 2004/0245946 | A1 * | 12/2004 | Halter | H01L 25/0753 315/312 |
| 2006/0028155 | A1 * | 2/2006 | Young | H05B 33/0818 315/308 |
| 2009/0079360 | A1 * | 3/2009 | Shteynberg | H05B 33/0818 315/291 |
| 2011/0006689 | A1 * | 1/2011 | Blanchard | H05B 33/0824 315/121 |
| 2011/0156593 | A1 * | 6/2011 | De Greef | H05B 33/0848 315/130 |
| 2011/0204801 | A1 * | 8/2011 | Smith | H05B 33/0815 315/192 |
| 2011/0310134 | A1 * | 12/2011 | Nakatsuka | G09G 3/3406 345/690 |
| 2011/0316448 | A1 * | 12/2011 | Ashdown | G09G 3/3426 315/297 |
| 2016/0174318 | A1 * | 6/2016 | Mignano | H05B 33/0845 315/201 |

* cited by examiner

CONTROL OF LED ARRAY IN A LIQUID CRYSTAL DISPLAY ASSEMBLY

TECHNICAL FIELD

The disclosure relates generally to control of an LED array in display assembly having a liquid crystal layer.

BACKGROUND

Many devices include various forms of displays, such as liquid crystal displays. Liquid crystal displays do not produce light by themselves and require some type of light source or backlighting to produce a visible image.

SUMMARY

A display assembly includes a display unit having a liquid crystal layer and an LED array configured to illuminate the liquid crystal layer. The display unit is configured to display an image. A driver circuit is operatively connected to the LED array and configured to control a luminance of the LED array. The LED array may include one or more LED light sources. A control module is operatively connected to the display unit and includes a processor and tangible, non-transitory memory on which is recorded instructions for executing a method for controlling the LED array in the display unit. The control module is programmed to obtain a junction temperature ($T_J$) of the LED array, via the driver circuit. The control module may be programmed to enter one of a plurality of stages based at least partially on the junction temperature ($T_J$).

The junction temperature ($T_J$) is based at least partially on a first voltage ($V_1$), a second voltage ($V_2$) and a predetermined coefficient ($T_{coefficient}$). The junction temperature ($T_J$) may be defined as: $T_J=[(V_2-V_1)*T_{coefficient}]$. The driver circuit may be programmed to apply a predefined first current to the LED array for a first time interval. The driver circuit may be programmed to apply a predefined second current to the LED array for a second time interval. In one embodiment, the predefined first current is about 10% of the maximum operating current (of the LED array) and the predefined second current is about 95% of the maximum operating current. The control module may be programmed to obtain the first voltage during the first time interval and the second voltage ($V_2$) during the second time interval, via a voltage-measuring device operatively connected to the LED array.

A video image adjustment module may be operatively connected to the control module and the display unit. The video image adjustment module is configured to control an appearance of the image displayed by the display unit. The control module is programmed to determine if image content is available for displaying the image.

The control module may be programmed to enter a first stage when the image content is not available and the junction temperature ($T_J$) is at or below a first threshold temperature ($T_1$). In the first stage, the control module may be programmed to set the image to black, via an image blanking signal to the video image adjustment module. In the first stage, the control module may be programmed to set the LED array to a maximum luminance, via a commanded luminance signal to the driver circuit, thereby accelerating preheating of the liquid crystal layer. The first control module may be programmed to exit the when the image content is available.

The control module may be programmed to enter a second stage when the image content is available and the junction temperature ($T_J$) is at or below the first threshold temperature ($T_1$). In the second stage, the control module may be programmed to send an image brightness signal to the video image adjustment module to lower brightness of the image. In the second stage, the control module may be programmed to set the LED array to a maximum luminance, via a commanded luminance signal to the driver circuit. The control module may be programmed to exit the second stage when the junction temperature ($T_J$) is above the first threshold temperature ($T_1$).

The control module may be programmed to enter a third stage when the image content is available and the junction temperature ($T_J$) is at or above a second threshold temperature ($T_2$). The second threshold temperature is above the first threshold temperature. In the third stage, the control module may be programmed to set the LED array to a maximum luminance for a predefined time ($t_0$), via a commanded luminance signal to the driver circuit such that the junction temperature ($T_J$) extends beyond a predefined maximum temperature of a de-rating curve. In the third stage after the predefined time ($t_0$), the control module may be programmed to reduce the commanded luminance signal such that the luminance of the LED array extends towards a descending portion of the de-rating curve. The control module may be programmed to exit the third stage when the luminance has reached the de-rating curve.

The control module may be programmed to enter a fourth stage when the image content is available and the junction temperature ($T_J$) is between the first threshold temperature ($T_1$) and the second threshold temperature ($T_2$). In the fourth stage, the control module may be programmed to reduce the power supplied to the LED array by the driver circuit to a predetermined rating, such that the predetermined rating is less than a maximum rating of the LED array.

The above features and advantages and other features and advantages of the present invention are readily apparent from the following detailed description of the best modes for carrying out the invention when taken in connection with the accompanying drawings.

DETAILED DESCRIPTION

Figure 1:
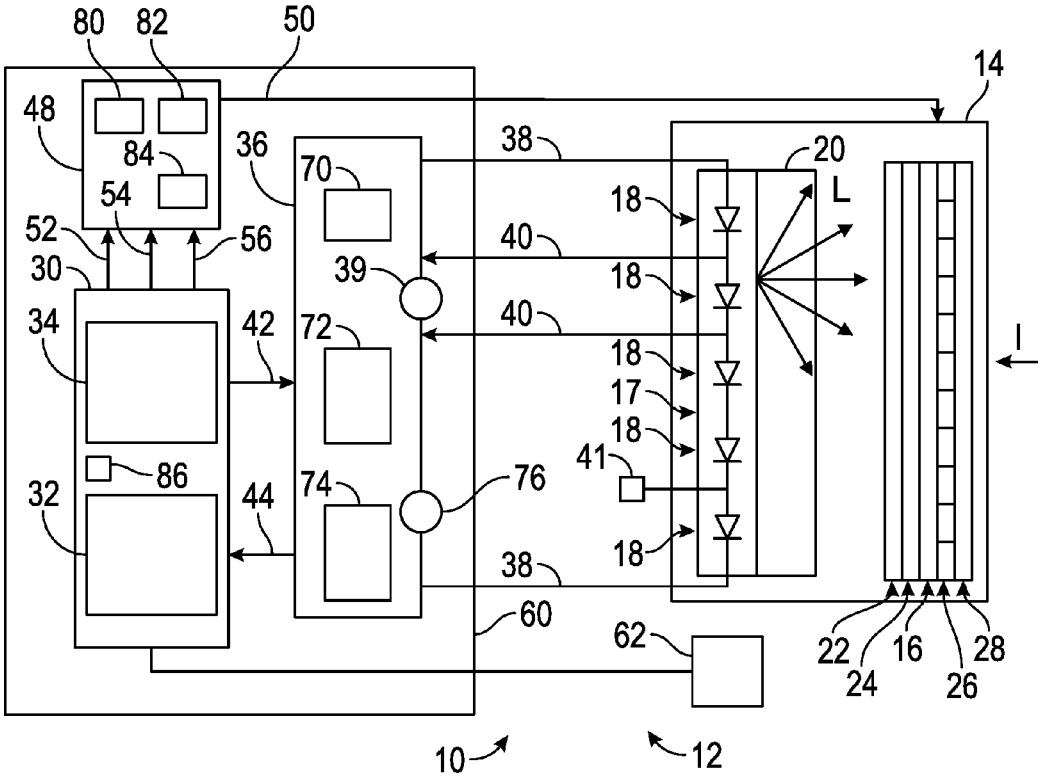
FIG. 1 is a schematic fragmentary view of a display assembly having an LED array, a liquid crystal layer and a control module.

Referring to the drawings, wherein like reference numbers refer to like components, FIG. 1 schematically illustrates a display assembly 10. Referring to FIG. 1, the display assembly may be part of a device 12. The device 12 may be a mobile platform, such as, but not limited to, standard passenger car, sport utility vehicle, light truck, heavy duty vehicle, ATV, minivan, bus, transit vehicle, bicycle, robot, farm implement, sports-related equipment, boat, plane, train or any other transportation device. The device 12 may be a non-mobile platform, including, but not limited to, a desktop computer, telephone, tablet and may take many different forms and include multiple and/or alternate components.

Referring to FIG. 1, the assembly 10 includes a display unit 14 including a liquid crystal layer 16 and an LED array 17 having at least one LED source 18. It is to be appreciated that any number of LED sources 18 may be employed in the LED array 17. The LED array 17 is configured to illuminate the liquid crystal layer 16, from any relative position, including but not limited to the side or back of the liquid crystal layer 16. An optical guide 20 may be positioned adjacent to the LED array 17 such that the light ("L" in FIG. 1) emitted by each LED source 18 passes through the optical guide 20. Referring to FIG. 1, the display unit 14 includes a first polarizing filter 22 to polarize the light L. The light L may subsequently pass through a TFT array 24, the liquid crystal layer 16, and a color filter 26. The light L must further pass through a second polarizing filter 28. Referring to FIG. 1, the display unit 14 is configured to display an image I. The display unit 14 may employ any type of display technology known to those skilled in the art.

Referring to FIG. 1, a control module 30 is operatively connected to the display unit 14. The control module 30 includes at least one processor 32 and at least one memory 34 (or any non-transitory, tangible computer readable storage medium) on which are recorded instructions for executing method 200, shown in FIG. 2, for controlling the LED array 17 in the display unit 14. The memory 34 can store control module-executable instruction sets, and the processor 32 can execute the control module-executable instruction sets stored in the memory 34. The control module 30 of FIG. 1 is specifically programmed to execute the steps of the method 200 (as discussed in detail below with respect to FIG. 2).

Referring to FIG. 1, a driver circuit 36 may be operatively connected to and configured to receive commands from the control module 30. The driver circuit 36 is configured to deliver a PWM current signal 38 to the LED array 17. A voltage-measuring device 39 may be employed to measure the LED differential junction voltage 40. The assembly 10 may include a thermistor 41.

Referring to FIG. 1, the control module 30 delivers a commanded luminance signal 42 to the driver circuit 36. The driver circuit 36 delivers an LED junction voltage signal 44 to the control module 30. As is understood by those skilled in the art, luminance is the luminous intensity projected on a given area and direction. Luminance is an objectively measurable attribute, with a unit of candela per square meter. Brightness is a subjective attribute of light, which may be scaled.

Referring to FIG. 1, a video image adjustment module 48 may be operatively connected to the control module 30 and the display unit 14. The video image adjustment module 48 is configured to control an appearance of the image I displayed by the display unit 14. The video image adjustment module 48 is configured to receive an input video content signal 52 from the control module 30 and send an output video content signal 50 to the display unit 14. The control module 30 is configured to send an image brightness signal 54 and an image blanking signal 56 to the video image adjustment module 48.

In the embodiment shown, the control module 30, the driver circuit 36 and the video image adjustment module 48 are part of a control unit 60. The control unit 60 of FIG. 1 may be an integral portion of, or a separate module operatively connected to, other modules of the device 12. A user interface 62 may be operatively connected to the control unit 60. The user interface 62 is configured to convey requests from a user (not shown) regarding various settings, including but not limited to, the level of image brightness, dimming and contrast.

Referring to FIG. 1, the driver circuit 36 may provide power to the LED array 17 using pulse width modulation (PWM). The average value of voltage or current delivered is controlled by turning a switch (not shown) on and off at a fast rate. This allows control of the power delivered to the LED array 17. The liquid crystal layer 16 may include a layer of molecules between two transparent electrodes. When a voltage is applied across the liquid crystal layer, the liquid crystal molecules re-orient themselves. By controlling the voltage applied across the liquid crystal layer 16 in each pixel, through the output video content signal 50, light can be allowed to pass through in varying amounts thus constituting different levels of gray.

Referring to FIG. 1, the driver circuit 36 includes a power supply 70 that supplies power to the LED array 17 and is controlled by a PWM control unit 72. The PWM control unit 72 provides a high frequency periodic drive signal of varying pulse width to direct the power supply, based at least partially upon a measured current from a current sensor 74 and a reference signal. In one embodiment, the drive signal is a square wave oscillating between 0 and 12 volts with a frequency of 30 kHz. The driver circuit 36 may include an oscillator 76 that provides a low (or high) frequency oscillating signal to the power supply 70 and the PWM control unit 72. Any type of driver circuit 36 known to those skilled in the art may be employed.

Referring to FIG. 1, the video image adjustment module 48 may include a first signal processing unit 80 for adjusting image brightness (based on the image brightness signal 54 from the control module 30), contrast, hue, saturation and sharpness. The video image adjustment module 48 may include a second signal processing unit 82 for processing the image blanking signal to blank the display of video information during predefined intervals, such as horizontal and vertical retrace intervals which occur between line and field image trace intervals, respectively. The video image adjustment module 48 may include a third signal processing unit 84 for scaling display resolution, de-interlacing, controlling aspect ratio, controlling frame rate conversion, color point conversion, color space conversion, noise reduction and various image enhancements. Any type of video image adjustment or processing units known to those skilled in the art may be employed.

Figure 2:
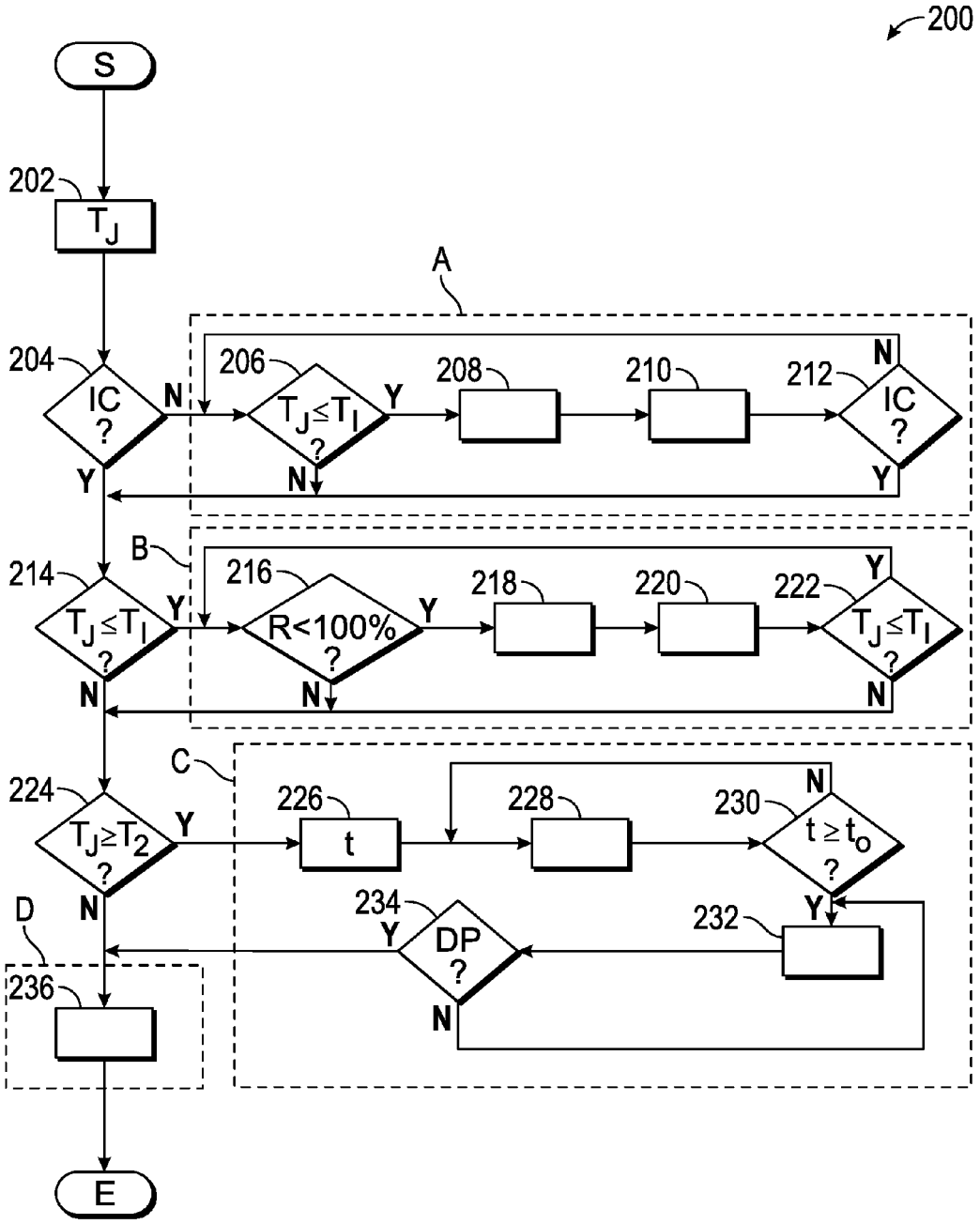
FIG. 2 is a flowchart of a method stored on and executable by the control module of FIG. 1.

Referring now to FIG. 2, a flowchart of the method 200 stored on and executable by the control module 30 of FIG. 1 is shown. The method 200 may include first, second, third and fourth stages, A, B, C and D. A typical control mechanism uses thermal protection during high temperature ambient, and reduces luminance of image when the internal display temperature increases. This reduction in luminance may result in a display that is difficult or impossible to see. Method 200 obviates these difficulties and increases the useful operating temperature range of a liquid crystal display. Method 200 employs an LED junction voltage measurement to estimate LED junction temperature, in place of stand-alone thermistor 41. Method 200 need not be applied in the specific order recited herein. Furthermore, it is to be understood that some steps may be eliminated. The start and end of the method 200 are indicated by "S" and "E," respectively. "Yes" and "no" are indicated by "Y" and "N," respectively.

Referring to FIG. 2, method 200 may begin when the control module 30 is "awake" or otherwise powered. In block 202 of FIG. 2, the control module 30 is programmed to obtain a junction temperature ($T_J$). The junction temperature ($T_J$) may be defined as the highest operating temperature of the semiconductor(s) in the LED array 17. In one example, the junction temperature ($T_J$) is taken to be the junction temperature of one pre-selected LED source 18 in the array 17. In another example, the junction temperature ($T_J$) is taken to be the mathematical average of the junction temperatures of some or all of the LED sources 18 in the array 17. In another example, the junction temperature ($T_J$) is taken to be a weighted average of the junction temperatures of some or all of the LED sources 18 in the array 17. The junction temperature is generally higher than the temperature of the exterior surface or case of the LED array 17. A two-step process of obtaining the junction temperature ($T_J$) is used, in place of a stand-alone thermistor 41.

Figure 3:
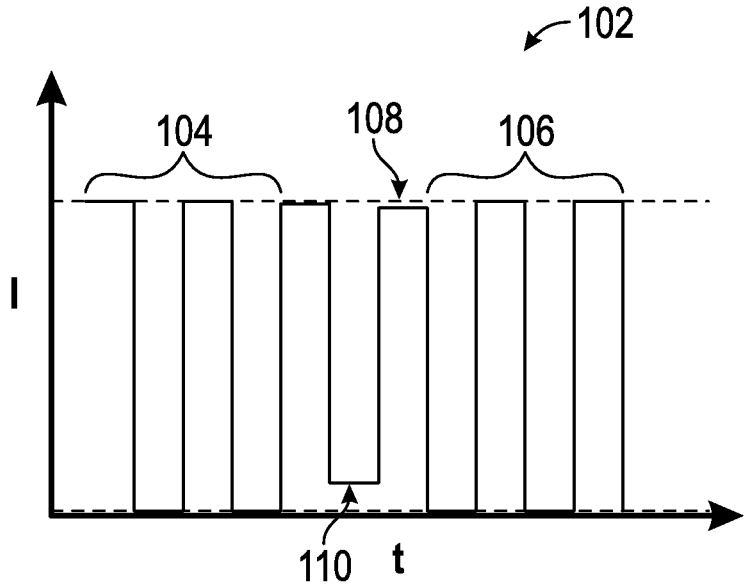
FIG. 3 is an example graph displaying current delivered to the LED array on the vertical axis and time on the horizontal axis.

FIG. 3 illustrates a trace 102 with current (I) delivered to the LED array 17 on the vertical axis and time (t) on the horizontal axis. Referring to FIG. 3, the driver circuit 36 (shown in FIG. 1) is configured to apply a two-step sequence between a first duty-cycle 104 and a second duty-cycle 106. Referring to FIG. 3, during the two-step sequence, the driver circuit 36 is programmed to apply a predefined first current 110 to the LED array 17 for a first time interval and a predefined second current 108 to the LED array 17 for a second time interval. In one embodiment, the predefined first current 110 is about 10% of the maximum operating current and the predefined second current 108 is about 95% of the maximum operating current. The control module 30 may be programmed to obtain the first voltage ($V_1$) during the first time interval and the second voltage ($V_2$) during the second time interval, via the voltage-measuring device 40.

The junction temperature ($T_J$) is obtained by using a thermal coefficient ($T_{coefficient}$) such that:

$$T_J=[(V_2-V_1)*T_{coefficient}].$$

The thermal coefficient ($T_{coefficient}$) may be obtained by calibration, i.e., plotting a series of voltage versus temperature readings as the current of the LED array 17 is incremented in a test cell and obtaining the slope of the relationship ($T_{coefficient}=\Delta V/\Delta T$). In one example, $T_{coefficient}$ is 2 mV/° C. By synchronizing the two-step measurement with other system information, such as oscillators, measurement error due to noise can be minimized.

In block 204 of FIG. 2, the control module 30 is programmed to determine if image content is available, i.e., if any digital values for the pixels forming the image I is available, in the display unit 14. If the image content is available in block 204, the method 200 proceeds to block 214 as described below. If not, the method 200 proceeds to block 206. In block 206, the control module 30 is programmed to determine if the junction temperature ($T_J$) is at or below a first threshold temperature ($T_1$). If so, the method 200 proceeds to block 208. If not, the method 200 proceeds to block 214.

The control module 30 may be programmed to enter a first stage A when the image content is not available and the junction temperature ($T_J$) is at or below a first threshold temperature ($T_1$). An example of this stage is a remote start for the device 12 during the winter season. The first stage A includes blocks 206, 208, 210 and 212.

In block 208, the control module 30 is programmed to set the image display to black, via the image blanking signal 56 to the video image adjustment module 48. In block 210, the control module 30 is programmed to set the LED array 17 to the maximum luminance, causing the display unit 14 to warm more quickly, via the commanded luminance signal 42 to the driver circuit 36. This results in a faster response time of the liquid crystal layer 16 (and less blur) when the image does appear later. In other words, the internal heat generated by the LED array 17 is employed to accelerate the preheating of the liquid crystal layer 16 when the image is inactive. Control module 30 may be programmed to exit the first stage A when the image content is available.

In block 214, the control module 30 is programmed to determine or verify that the junction temperature ($T_J$) is at or below the first threshold temperature ($T_1$). If so, the method 200 proceeds to second stage B, which may also be referred to as the low-ambient temperature stage. If not, the method 200 proceeds to block 224. The second stage B includes blocks 216, 218, 220 and 222. An example of second stage B is a night time starting of the device 12 during the winter season. The temperature of the display unit 14 is low and the image display is less than full intensity. When the display unit 14 is first turned on during a relatively low temperature condition, image motion blur may be present.

In block 216, the control module 30 is configured to determine if a dimming request ("R" in FIG. 2) (by the user interface 62 of FIG. 1) is less than 100%. In other words, the image display is less than full intensity. If so, the method 200 proceeds to blocks 218 and 220. If not, it proceeds to block 224. The dimming request ("R") may conveyed by a user to the control module 30 via the user interface 62. The PWM control unit 72 of the driver circuit 36 may perform dimming (upon command of the control module 30) by turning the power to the LED on and off at a sufficiently fast rate such that the flicker is not detectable by the human eye.

In block 218, to help the liquid crystal layer 16 warm more quickly, the control module 30 is programmed to set the LED array 17 to a maximum luminance, via a commanded luminance signal 42 to the driver circuit 36. This leads to a faster response time of the liquid crystal layer 16, and less image blur. In block 220, the control module 30 is programmed to lower the image brightness, via the image brightness command 54 from the control module 30 to the video image adjustment module 48. The control module 30 may be programmed to exit the second stage B when the junction temperature ($T_J$) is above the first threshold temperature ($T_1$). In block 220, the controller is programmed to determine if the junction temperature ($T_J$) is less than the first threshold temperature ($T_1$). If so, the method 200 loops back to block 216. If not, the method 200 proceeds to block 224.

The control module 30 may be programmed to enter a third stage C when the image content is available and the junction temperature ($T_J$) is at or above a second threshold temperature ($T_2$), which is above the first threshold temperature ($T_1$). Referring to FIG. 3, in block 224, the control module 30 is programmed to determine if the junction temperature ($T_J$) is at or above the second threshold temperature ($T_2$). If so, the method 200 begins the third stage C, which includes blocks 226, 228, 230, 232 and 234. If not, the method 200 proceeds to block 236. An example application of the third stage C is a device 12 that is started after soaking in a desert sun. The temperature of the display unit 14 is high enough that normally the backlight intensity is reduced, making the image difficult to see. In one example, the first threshold temperature ($T_1$) is −40° C. and the second threshold temperature ($T_2$) is 75° C.

In block 226, the control module 30 is programmed to begin a timer 86 (see FIG. 1) for a predefined time ($t_0$). The timer 86 may be operatively connected to the control module 30 or may be an integral portion of the control module 30. In block 228, the control module 30 is programmed to set the LED array 17 to a maximum requested luminance for the predefined time ($t_0$), via the commanded luminance signal to the driver circuit 36 such that the junction temperature ($T_J$) extends beyond a predefined maximum temperature 306 of a de-rating curve 301, an example of which is shown in FIG. 4.

Figure 4:
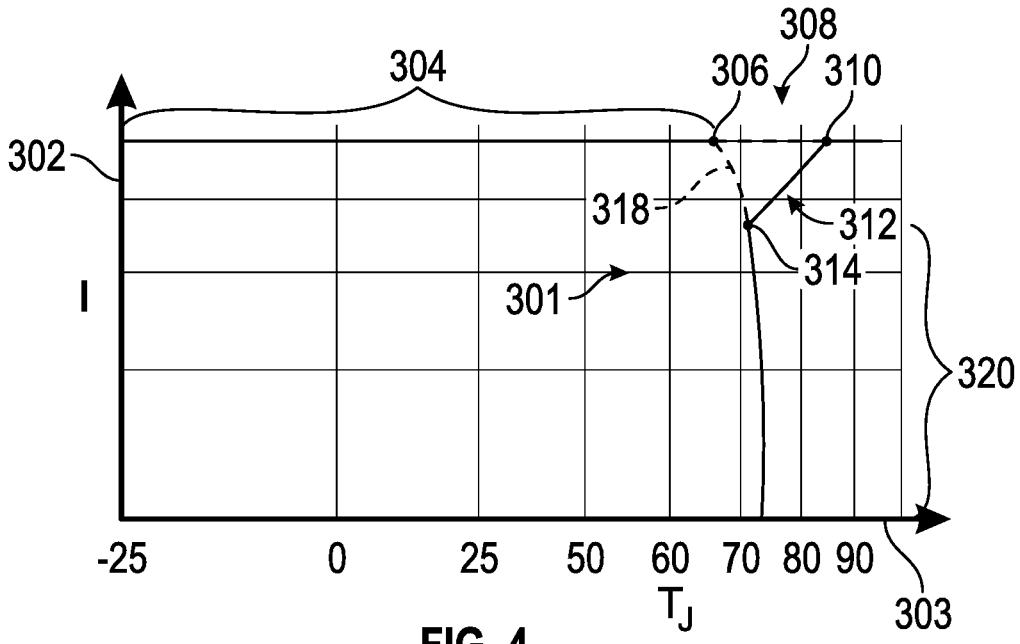
FIG. 4 is an example de-rating curve for the LED array of FIG. 1, displaying luminance of the LED array on the vertical axis and junction temperature on the horizontal axis.

Referring to FIG. 4, an example de-rating curve 301 for the LED array 17 is shown, displaying luminance (or intensity) of the LED array 17 on the vertical axis 302 and junction temperature ($T_J$) on the horizontal axis 303. The de-rating curve 301 is not shown to scale and it is to be understood that the numbers shown are intended to be non-limiting examples. The de-rating curve 301 includes a flat portion 304 that ends at the predefined maximum temperature 306. In block 228, the control module 30 is programmed to allow the LED array 17 to exceed the predefined maximum temperature 306 along a first curve portion 308 to reach a shifted maximum temperature 310 (see FIG. 4).

In block 230, the control module 30 is programmed to determine if the timer 86 has expired. If the timer 86 has not expired, the method 200 loops back to block 228. In block 232, if the timer 86 has expired, the control module 30 is programmed to reduce the commanded luminance signal such that the LED array travels the second curve portion 312, from the shifted maximum temperature 310 to the point 314 of the de-rating curve 301. The first and second curve portions 308 and 312 deviate from a typical de-rating curve, bypassing the portion 318 of a typical de-rating curve.

The control module 30 may be programmed to exit the third stage C when the luminance has reached the point 314 of the descending portion 320 of the de-rating curve 301. In block 234, control module 30 is programmed to determine if the luminance has reached the descending portion 320 (shown as "DP?" in block 234) of the de-rating curve 301 (at point 314). If so, the method 200 proceeds to block 236. If not, method 200 loops back to block 232.

The control module 30 may be programmed to enter a fourth stage D when the image content is available; and the junction temperature ($T_J$) is between the first threshold temperature ($T_1$) and the second threshold temperature ($T_2$). The fourth stage D includes block 236. In block 236, the control module 30 is programmed to reduce the power supplied to the LED array 17 by the driver circuit 36 to a predetermined rating, such that the predetermined rating is less than a maximum allowable rating of the LED array 17.

In summary, the method 200 may include four stages, A through D. The first stage A uses the LED array 17 as a thermal source to accelerate the preheating of liquid crystal when the image is inactive. The second stage B uses the LED array 17 and image adjustment/control to increase warming of the liquid crystal layer 16 when the image is active. The third stage C allows full luminance of the LED array 17 for a pre-defined duration while above a predefined second threshold temperature. In the fourth stage D, the power rating of the LED is reduced to a predetermined reduced rating less than the maximum rated capabilities.

The control module 30 (and execution of the method 200) improves the functioning of the device 12 by improving the readability of the image I observed in the display unit 14, thereby improving accuracy of user interaction with the device 12. For example, a user may rely on the readability of the image I to make control decisions for the device 12, e.g. changing the trajectory of the device 12.

Referring to FIG. 1, the control module 30, the driver circuit 36, the video image adjustment module 48, the control unit 60 may each include a respective computer-readable medium (also referred to as a processor-readable medium), including any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which may constitute a main memory. Such instructions may be transmitted by one or more transmission media, including coaxial cables, copper wire and fiber optics, including the wires that comprise a system bus coupled to a processor of a computer. Some forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Look-up tables, databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store may be included within a computing device employing a computer operating system such as one of those mentioned above, and may be accessed via a network in any one or more of a variety of manners. A file system may be accessible from a computer operating system, and may include files stored in various formats. An RDBMS may employ the Structured Query Language (SQL) in addition to a language for creating, storing, editing, and executing stored procedures, such as the PL/SQL language mentioned above.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A display assembly comprising:

a display unit having a liquid crystal layer and an LED array configured to illuminate the liquid crystal layer, the display unit configured to display an image;

a driver circuit operatively connected to the LED array, the driver circuit being configured to control a luminance of the LED array;

a control module operatively connected to both the display unit and the driver circuit, the control module including a processor and tangible, non-transitory memory on which is recorded instructions for executing a method for controlling the LED array in the display unit;

wherein execution of the instructions by the processor causes the control module to obtain a junction temperature ($T_J$) of the LED array, via the driver circuit;

wherein the junction temperature ($T_J$) is based at least partially on a first voltage ($V_1$), a second voltage ($V_2$) and a predetermined coefficient ($T_{coefficient}$);

wherein the control module is programmed to determine if an image content is available for displaying the image;

wherein the control module is programmed to enter one of a plurality of stages based at least partially on the junction temperature ($T_J$); and wherein the control module is programmed to enter a first stage of the plurality of stages when the image content is not available and the junction temperature ($T_J$) is at or below a first threshold temperature ($T_1$).

2. The assembly of claim 1, wherein the junction temperature ($T_J$) is defined as: $T_J=[(V_2-V_1)*T_{coefficient}]$.

3. The assembly of claim 1, further comprising:

a voltage-measuring device operatively connected to the LED array:

wherein the driver circuit is programmed to apply a predefined first current to the LED array for a first time interval; and wherein the driver circuit is programmed to apply a predefined second current to the LED array for a second time interval; and wherein the control module is programmed to obtain the first voltage ($V_1$) during the first time interval and the second voltage ($V_2$) during the second time interval, via the voltage-measuring device.

4. The assembly of claim 3, wherein the predefined first current is about 10% of the maximum operating current and the predefined second current is about 95% of the maximum operating current.

5. The assembly of claim 1, wherein the driver circuit does not employ a thermistor to measure the junction temperature ($T_J$).

6. The assembly of claim 1, further comprising:

a video image adjustment module operatively connected to the control module and the display unit;

wherein the control module is programmed to:

in the first stage, set the image to black, via an image blanking signal to the video image adjustment module;

in the first stage, set the LED array to a maximum luminance, via a commanded luminance signal to the driver circuit, thereby accelerating preheating of the liquid crystal layer; and exit the first stage when the image content is available.

7. The assembly of claim 1, wherein control module is programmed to:

determine if an image content is available for displaying the image;

enter a second stage of the plurality of stages when the image content is available and the junction temperature ($T_J$) is at or below the first threshold temperature ($T_1$); and exit the second stage when the junction temperature ($T_J$) is above the first threshold temperature ($T_1$).

8. The assembly of claim 7, further comprising:

a video image adjustment module operatively connected to the control module and the display unit;

wherein the control module is programmed to:

in the second stage, send an image brightness signal to the video image adjustment module to lower brightness of the image; and in the second stage, set the LED array to a maximum luminance, via a commanded luminance signal to the driver circuit.

9. The assembly of claim 1, wherein control module is programmed to:

determine if an image content is available for displaying the image;

enter a third stage of the plurality of stages when the image content is available and the junction temperature ($T_J$) is at or above a second threshold temperature ($T_2$); and wherein the second threshold temperature is above the first threshold temperature.

10. The assembly of claim 1, wherein the control module is programmed to:

in the third stage, set the LED array to a maximum luminance for a predefined time ($t_0$), via a commanded luminance signal to the driver circuit such that the junction temperature ($T_J$) extends beyond a predefined maximum temperature of a de-rating curve; and in the third stage, after the predefined time ($t_0$), adjust the commanded luminance signal such that the luminance of the LED array reaches a descending portion of the de-rating curve; and exit the third stage when the luminance has reached the de-rating curve.

11. The assembly of claim 1, wherein the control module is programmed to:

determine if an image content is available for displaying the image;

enter a fourth stage of the plurality of stages when the image content is available and the junction temperature ($T_J$) is between the first threshold temperature ($T_1$) and the second threshold temperature ($T_2$).

12. The assembly of claim 11, wherein:

the control module is programmed to, in the fourth stage, reduce the power supplied to the LED array by the driver circuit to a predetermined rating; and the predetermined rating is less than a maximum rating of the LED array.

13. A display assembly comprising:

a display unit having a liquid crystal layer and an LED array configured to illuminate the liquid crystal layer, the display unit configured to display an image;

a driver circuit operatively connected to the LED array, the driver circuit being configured to control a luminance of the LED array;

a control module operatively connected to both the display unit and the driver circuit, the control module including a processor and tangible, non-transitory memory on which is recorded instructions for executing a method for controlling the LED array in the display unit;

a voltage-measuring device operatively connected to the LED array:

wherein execution of the instructions by the processor causes the control module to obtain a junction temperature ($T_J$) of the LED array, via the driver circuit;

wherein the junction temperature ($T_J$) is based at least partially on a first voltage ($V_1$), a second voltage ($V_2$) and a predetermined coefficient ($T_{coefficient}$);

wherein the control module is programmed to enter one of a plurality of stages based at least partially on the junction temperature ($T_J$);

wherein the driver circuit is programmed to apply a predefined first current to the LED array for a first time interval;

wherein the driver circuit is programmed to apply a predefined second current to the LED array for a second time interval; and wherein the control module is programmed to obtain the first voltage ($V_1$) during the first time interval and the second voltage ($V_2$) during the second time interval, via the voltage-measuring device.

14. A method for controlling a display assembly having a display unit with a liquid crystal layer and an LED array configured to illuminate the liquid crystal layer, the display unit being configured to display an image, the assembly further including a driver circuit configured to control a luminance of the LED array, and a control module having a processor, and tangible, non-transitory memory on which is recorded instructions, the method comprising:

obtaining a junction temperature ($T_J$) of the LED array, via the driver circuit, the junction temperature ($T_J$) being based at least partially on a first voltage ($V_1$), a second voltage ($V_2$) and a predetermined coefficient ($T_{coefficient}$);

entering one of a plurality of stages based at least partially on the junction temperature ($T_J$), via the control module;

determining if an image content is available for displaying the image, via the control module; and entering a first stage of the plurality of stages when the image content is not available and the junction temperature ($T_J$) is at or below a first threshold temperature ($T_1$), via the control module.

15. The method of claim 14, wherein the assembly includes a video image adjustment module operatively connected to the control module and the display unit, and further comprising:

in the first stage, setting the image to black, via an image blanking signal to the video image adjustment module;

in the first stage, setting the LED array to a maximum luminance, via a commanded luminance signal to the driver circuit, thereby accelerating preheating of the liquid crystal layer; and exiting the first stage when the image content is available, via the control module.

16. The method of claim 14, further comprising:

entering a second stage of the plurality of stages when the image content is available and the junction temperature ($T_J$) is at or below the first threshold temperature ($T_1$), via the control module; and exiting the second stage when the junction temperature ($T_J$) is above the first threshold temperature ($T_1$), via the control module.

17. The method of claim 16, wherein the assembly includes a video image adjustment module operatively connected to the control module and the display unit, and further comprising:

in the second stage, sending an image brightness signal to the video image adjustment module to lower brightness of the image, via the control module; and in the second stage, setting the LED array to a maximum luminance, via a commanded luminance signal to the driver circuit.

18. The method of claim 14, further comprising:

entering a third stage of the plurality of stages when the image content is available and the junction temperature ($T_J$) is at or above a second threshold temperature ($T_2$), via the control module; and wherein the second threshold temperature is above the first threshold temperature.

19. The method of claim 14, further comprising:

in the third stage, setting the LED array to a maximum luminance for a predefined time ($t_0$), via a commanded luminance signal to the driver circuit such that the junction temperature ($T_J$) extends beyond a predefined maximum temperature of a de-rating curve;

in the third stage, after the predefined time ($t_0$), adjusting the commanded luminance signal such that the luminance of the LED array reaches a descending portion of the de-rating curve; and exiting the third stage when the luminance has reached the de-rating curve, via the control module.

20. The method of claim 14, further comprising:

entering a fourth stage of the plurality of stages when the image content is available and the junction temperature ($T_J$) is between the first threshold temperature ($T_1$) and the second threshold temperature ($T_2$), via the control module.

* * * * *